United States Patent [19]

Mine

[11] Patent Number: 4,469,171

[45] Date of Patent: Sep. 4, 1984

[54] WIRELINE GUIDING APPARATUS

[76] Inventor: Paul Mine, 113 Tyrona St., Lafayette, La. 70507

[21] Appl. No.: 392,620

[22] Filed: Jun. 28, 1982

[51] Int. Cl.[3] ..... E21B 19/00; E21B 33/08

[52] U.S. Cl. ..... 166/85; 166/84; 242/157 R; 254/336; 254/415

[58] Field of Search ..... 166/85, 77; 175/85; 254/415, 335, 336; 242/157 R

[56] References Cited

U.S. PATENT DOCUMENTS

| | | | |
|---|---|---|---|
| 1,559,000 | 10/1925 | Packer | 254/415 |
| 3,104,094 | 9/1963 | Liem et al. | 254/415 |
| 3,804,168 | 4/1974 | Marshall et al. | 166/250 |
| 3,912,230 | 10/1975 | Learmont | 254/336 |

FOREIGN PATENT DOCUMENTS

| | | | |
|---|---|---|---|
| 715440 | 11/1979 | U.S.S.R. | 254/335 |

*Primary Examiner*—James A. Leppink
*Assistant Examiner*—Mark J. Del Signore
*Attorney, Agent, or Firm*—Thomas S. Keaty

[57] ABSTRACT

A wireline guide for use in oil-well industry has three arms, each of which is made of parallel elongated trusses with support plates attached between the trusses. The first, lower arm is fixedly attached at 45° angle to a collar of a pack-off assembly, the second arm is swivelly attached at its lower end at 45° angle to the upper portion of the first arm, the second hand having a first pulley wheel rotatably mounted between the trusses at the upper portion of the second arm. A bumper is integrally mounted to the upper portion of the second arm in order to prevent contact between a traveling block and the wireline. The lowermost pair of support plates attached to the swivel arm are mounted at 45° angle in relation to the trusses. A third, removable arm is mounted at its lower end between the angular support plates and extends vertically upwardly from the second arm. The uppermost reinforcing plates of the third arm are mounted at 45° angle to the trusses, one of which has a diagonal wireline slot. A second pulley wheel is mounted atop the third arm between the trusses. The second arm can be swivelled 180° outwardly from the pack-off assembly when wireline operations are not in progress.

5 Claims, 5 Drawing Figures

WIRELINE GUIDING APPARATUS

FIELD OF THE INVENTION

The present invention relates to a novel apparatus for guiding wireline, especially within the derrick of an oil rig, during wireline operations, for preventing fraying of and damage to the wireline by preventing the wireline from rubbing against the cable and swivel which travel up and down within the oil derrick and against the pack-off assembly and pack-off seals mounted therein, thereby preventing damage and wear to the cable and to the pack-off assembly and pack-off seals mounted therein.

BACKGROUND OF THE PRESENT INVENTION

Within the context of an oil rig operation, it has become necessary within the past fifteen years to conduct wireline operations, wherein a wireline unit disposed adjacent to the rig floor drives a steel cable, or wireline as it referred to in the oil industry, around a pulley wheel mounted at the top of the oil derrick, the wireline then traveling downwardly within the oil derrick towards the rig floor and ultimately down the pack-off assembly which is connected on its bottom end to the circulating head which is mated on its bottom end with the drill pipe. Simply stated, the primary function of the wireline is to "steer" the drill pipe for directional drilling wherein a bent sub is connected to the bottom of the bottommost drill pipe in the wellbore, the bent sub having a drilling bit mounted to its outer end for drilling; the wireline is driven or "shot" down the pack-off assembly and down the drill pipe until it connects with a mechanism which guides or "steers" the bent sub to facilitate drilling in the proper direction. The wireline is also similarly "shot" down the drill pipe to "fish" for "junk" which has fallen down or otherwise lodged itself within any part of the drill pipe, generally at the bottom thereof, the "junk" usually consisting of broken drilling bits, tools, or materials that have been accidentally dropped into the drill pipe, etc. Wireline is employed to retrieve the "junk" therefrom so that drilling or other operations can be resumed.

Wireline operations have been plagued from the beginning by problems largely due to damaged and frayed wireline which is caused by the wireline rubbing against the cable traveling around the crown block at the top of the oil derrick and therefrom up and down within the oil derrick, and against the swivel known in the oil industry as the traveling block, attached to the cable. This rubbing action is due to the angle at which the wireline travels within the oil derrick after being driven from the wireline unit around the pulley wheel positioned at the top of the oil derrick. Furthermore, because of this angle, as the wireline is "shot" or driven down the pack-off assembly, the circulating head, and the drill pipe, the wireline rubs against the packing nut of the pack-off assembly and after a short period of time cuts a groove into the packing nut, which is the top part of the pack-off assembly, and cuts a groove into a plurality of pack-off seals mounted within the lower body of the pack-off assembly for preventing the upflow of circulating fluids from the circulating head through the pack-off assembly and onto the rig floor. Within a short period of time, the pack-off seals become damaged by the cutting/rubbing action of the wireline to such an extent that they become irrepairably damaged, thereby permitting the upflow of circulating fluids from the circulating head through the pack-off assembly and onto the rig floor. Drilling operations must be stopped while the rig floor is cleaned and to replace the pack-off seals which have been ruined; not only is the spilled fluid messy, but it is easily discernible that it can cause injuries to workmen working on the rig floor. Therefore, because of the damage to the pack-off seals, costs are incurred to replace the seals and the rig is temporarily shutdown at great cost due to the high cost of labor and the high rental cost of the rig and operating equipment, tools, and materials that merely lay idle during this shutdown period. The primary cause of concern, however, is the damage occasioned to the wireline by the rubbing of the wireline against the cable and travelling block. Wireless oftentimes travels down the drill pipe to depths of 25,000 ft., depending, of course, upon the depth of the wellbore. The wireline begins to "strand" or fray after rubbing for some time against the cable, travelling block, and pack-off assembly, and this damage dangerously weakens the wireline, eventually irreparably damaging the wireline, rendering it unfit for further use. Wireline has been used for approximately 1 to 150 "trips" in the past, a "trip" being defined as the movement of the wireline up and down within the drill pipe one time. The present invention has for its primary object the prevention of this rubbing action between the wirelines and the cable, traveling block, and pack-off assembly, thereby preventing the fraying of and damage to the wireline and extending the average useful life of the wireline to over 300 "trips," a marked improvement over the present approximately 50 "trips" average useful life of wireline. When the wireline becomes so damaged that it must be replaced, great expenses and delays are incurred. Wireline usually must be shipped out to the platform in the case of offshore oil operations or trucked out to an onshore oil rig, resulting in fairly heavy costs and requiring a shutdown of the oil rig and the consequent costs involved therewith because of the high cost of materials and labor laying idle during this shutdown period. The wireline itself costs between $10,000 to $20,000 to replace. It is easy to perceive how valuable the apparatus of the present invention will be to the oil industry.

SUMMARY OF THE INVENTION

The present invention teaches an apparatus for guiding the wireline in order to prevent the wireline from rubbing against the cable, the traveling block, and the pack-off assembly, or any other thing within the oil derrick for preventing damage to the cable, the travelling block, the pack-off assembly, or to the wireline, thereby extending their useful lives and thereby saving much time (i.e. reducing rig shutdown time) and money and increasing the overall efficiency of the oil rig operation.

The present invention comprises a structure mounted to a collar which is slidably, but securably mounted to the pack-off assembly, preferably, by even a single workman, wherein the structure comprises a pair of pulley wheels, one near the top and one near the bottom of the structure, which are positioned to receive the wireline as it travels downwardly within the oil derrick, the top pulley being positioned to guide the wireline so as to prevent frictional engagement between the wireline and the cable and the travelling block, thereby preventing damage to the wireline or to the cable and traveling block, and the bottom pulley being positioned to guide the wireline down the pack-off assembly, preferably down its longitudinal axis, so as to prevent the wireline from frictionally engaging the pack-off assembly and pack-off seals mounted therein, thereby preventing damage to the wireline or to the pack-off assembly and pack-off seals.

DETAILED DESCRIPTION OF THE PREFERRED EMBODIMENT

Figure 1:
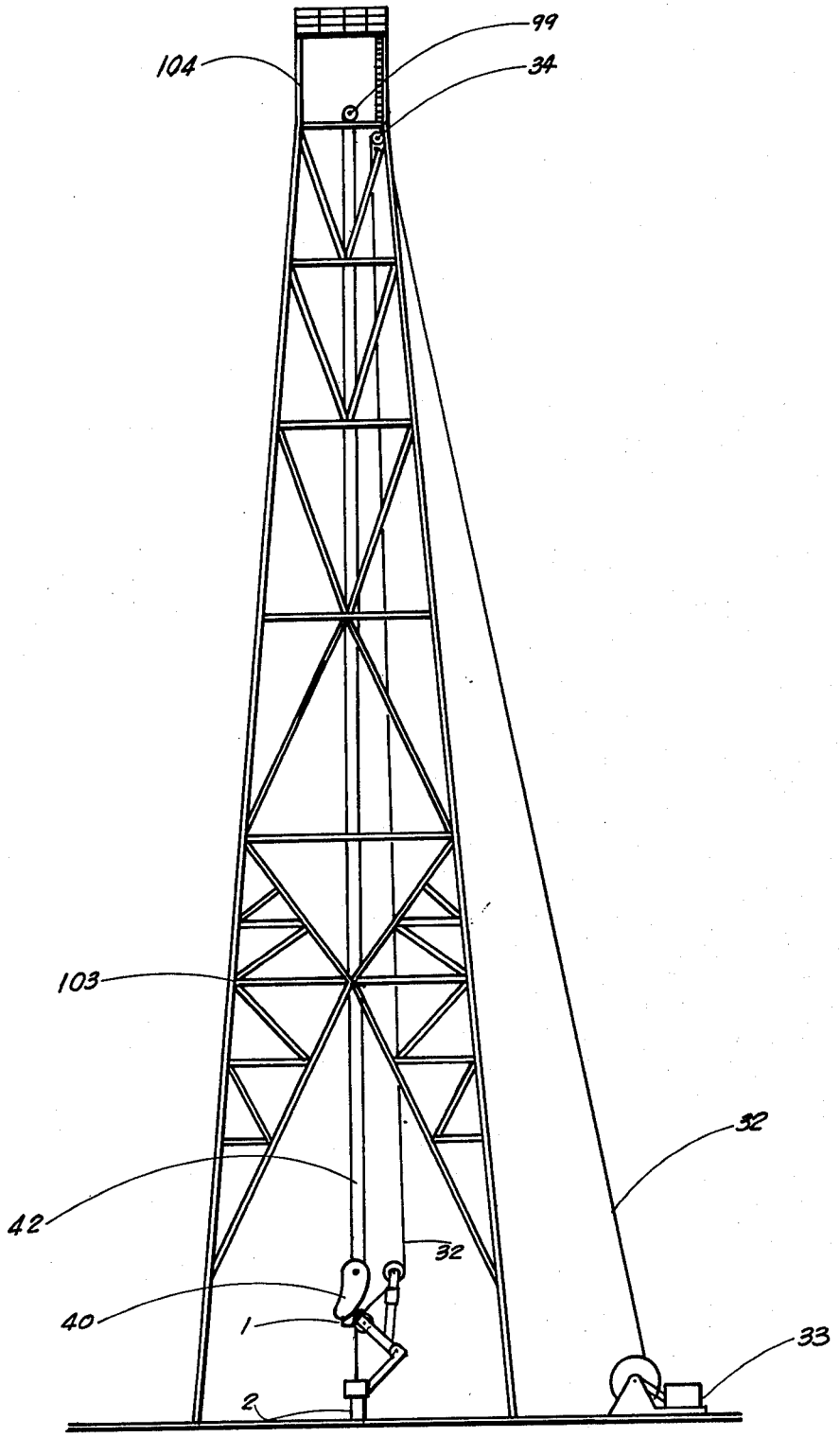
FIG. 1 is a frontal, elevational view of the apparatus of the present invention mounted within an oil derrick.
Figure 2:
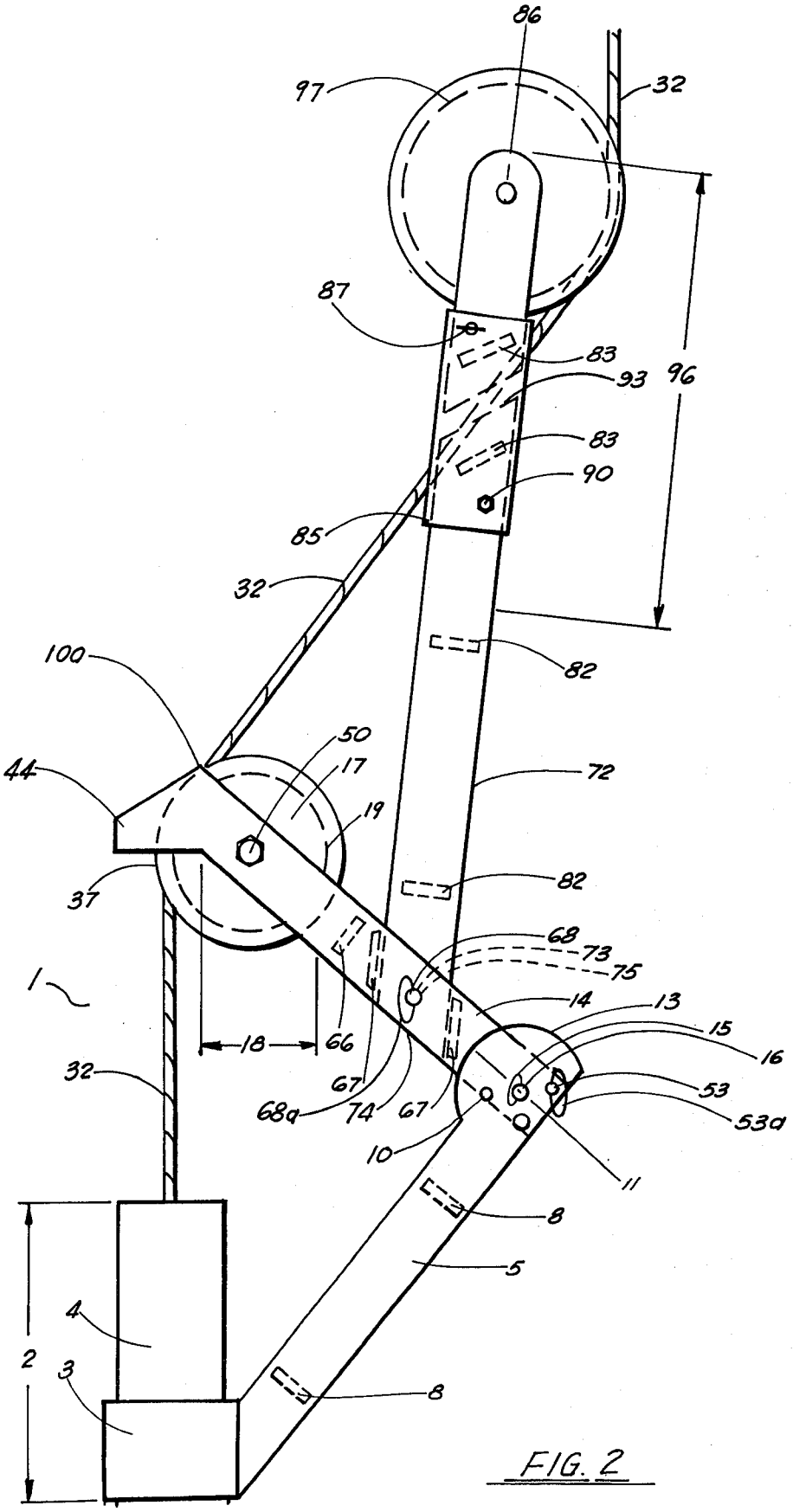
FIG. 2 is a frontal, elevational view of the apparatus of the present invention, in isolation.
Figure 3:
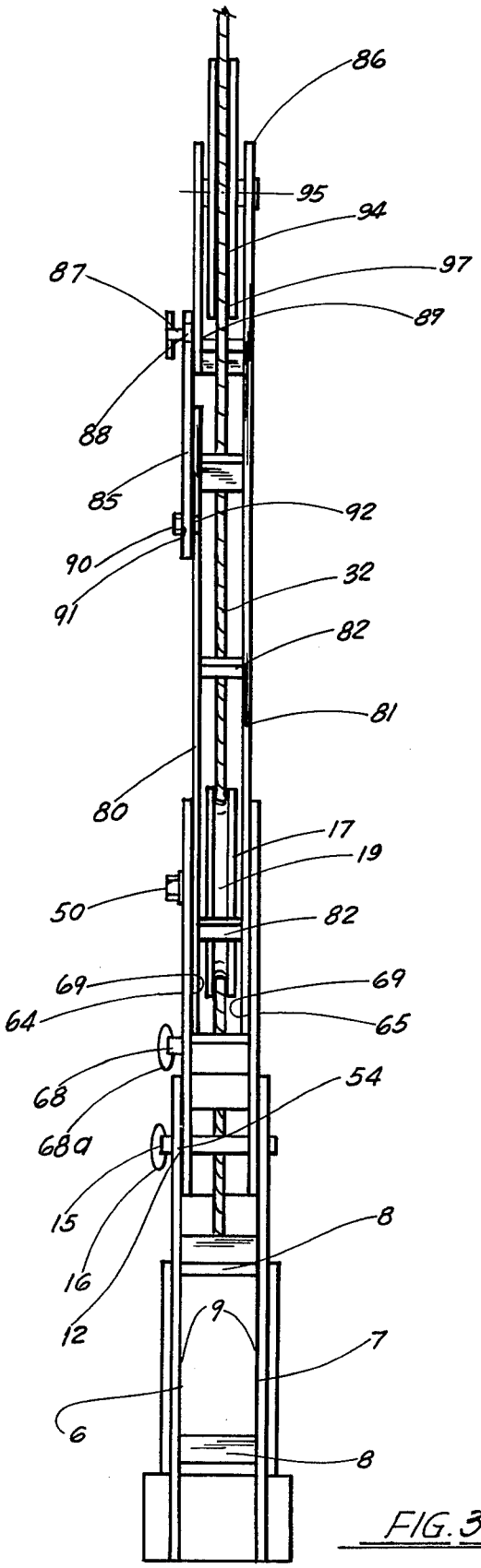
FIG. 3 is a side, elevational view of the apparatus of the present invention, in isolation.
Figure 5:
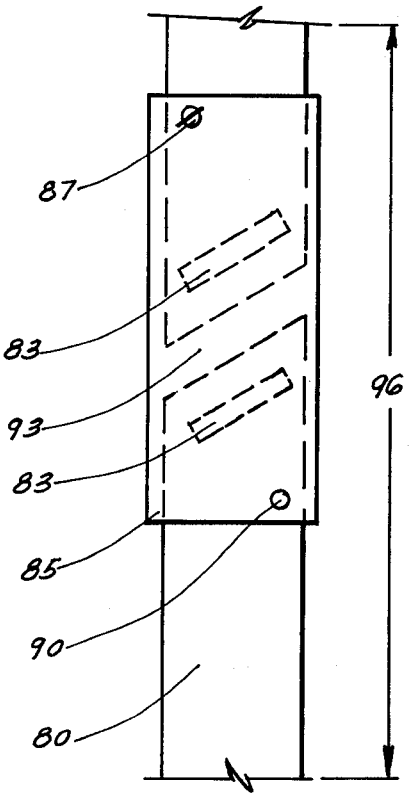
FIG. 5 is an isolated, frontal, elevational view of the upper end portion of the upper arm of the apparatus of the present invention.
Figure 4:
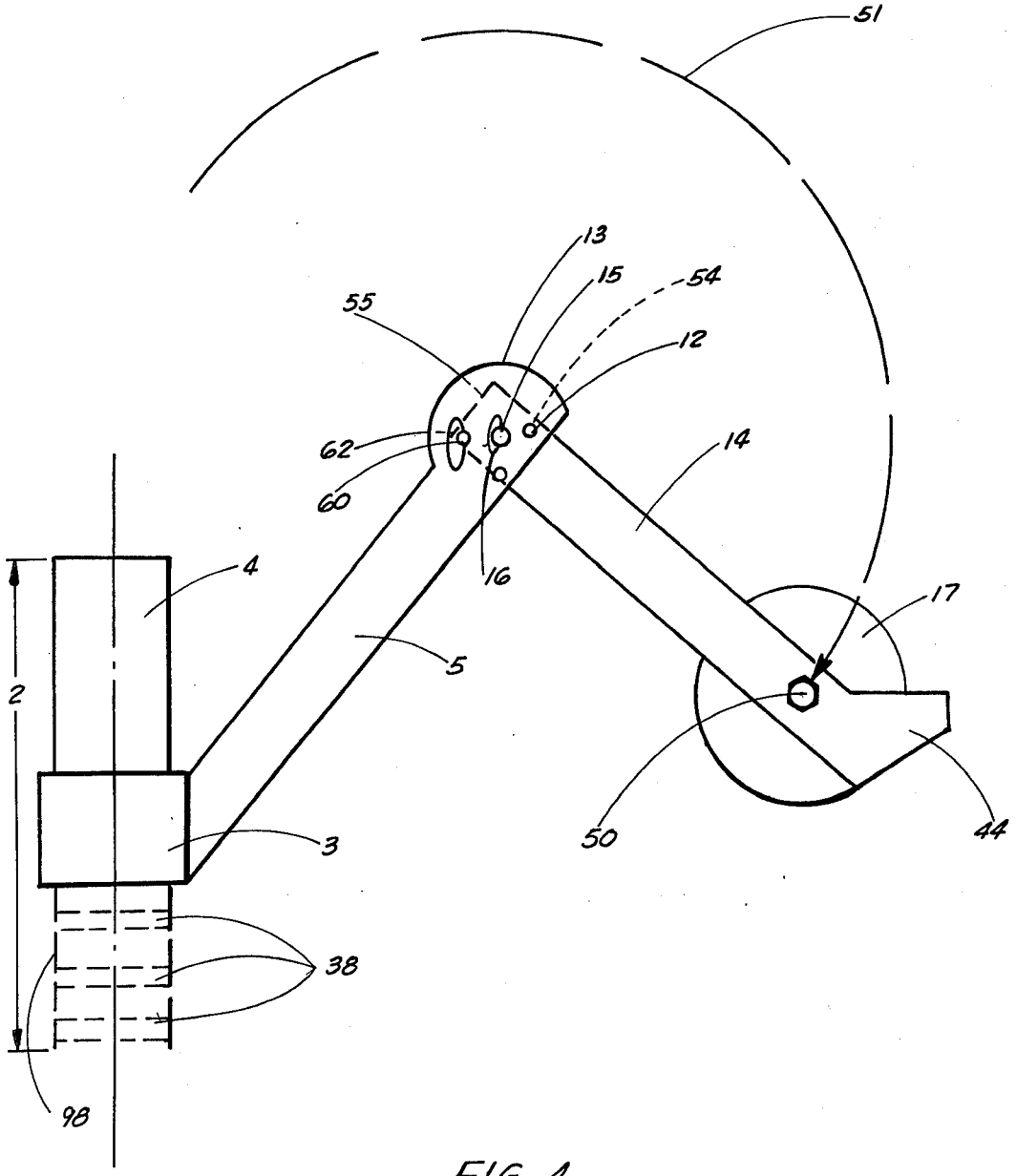
FIG. 4 is a frontal, elevational view of the stationary and swivel arm part of the apparatus of the present invention mounted to the pack-off assembly, with the swivel arm in its idle position.

There can be seen in FIG. 1, the apparatus of the present invention, indicated generally by numeral 1, mounted to the pack-off assembly 2 within an oil derrick 103. As best seen in FIG. 2, the apparatus 1 comprises a generally cylindrical collar 3 having a slightly greater outer diameter than the packing nut portion 4 of pack-off assembly 2, to which it is circumferentially, slidably, securably mounted. A lower, stationary arm 5 is fixably attached, preferably, to collar 3, extending upwardly and outwardly therefrom at an approximately 45 degree angle from collar 3 in the preferred embodiment. As can best be seen in FIG. 3, arm 5 comprises spaced-apart trusses 6, 7 reinforced by support plates 8, which are, preferably, fixably attached, for example, welded, to the inner walls 9 of trusses 6, 7, substantially perpendicularly thereto. Arm 5 comprises apertures 10, 11, 12, provided in spaced relationship to each other, through arm 5 near the top 13 thereof, for reasons which hereinafter will be discussed. A lower, removable, swivel arm 14 is swivelly mounted, preferably, to stationary arm 5, by means of pin 15 passing through central aperture 11 of arm 5, carter pin 16 being inserted therethrough, thereby swivelly connecting swivel arm 14 to stationary arm 5, swivel arm 14 and stationary arm 5 forming an approximately 45 degree angle in the preferred embodiment. A sheave 17, or pulley wheel 17, is rotatably mounted, for example, by means of bearing pin 50, within the outer end portion 18 of swivel arm 14, pulley wheel 17 having an annular groove 19 for receiving wireline 32 which is driven by wireline unit 33 disposed adjacent to oil derrick 103 over pulley wheel 34 mounted near the top of oil derrick and downwardly therefrom into the oil derrick 103 for the conducting of wireline operations as described in the Background of the Invention. In the preferred embodiment, swivel arm 14 is adjustable from a first, or operating position, as seen in FIG. 2, wherein the outer end 37 of pulley wheel 17 is substantially coincidental with the longitudinal axis of pack-off assembly 2, pulley wheel 17 thereby guiding wireline 32 down pack-off assembly 2 during wireline operations, thereby preventing damage to wireline 32 and to pack-off assembly 2 and pack-off seals 38 mounted therein; and a second, or idle position as shown by arrow 51 in FIG. 4, wherein swivel arm 14 is swung outwardly and upwardly along an approximately 180 degree arcuate path from the first position, so that arm 14 does not impede oil rig operations when wireline operations are ceased. A bumper guard 44 is fixably attached, for example, welded, to the outer end 100 of swivel arm 14, bumper guard 44 comprising a generally polygonal, hollow steel member for preventing contact between travelling block 40 and wireline 32. As seen in FIG. 2, swivel arm 14 is secured into the operating position by means of pin 53 passing through aperture 54 provided through swivel arm 14 in the base 55 thereof, and through aperture 12 provided through stationary arm 5 near the top 13 thereof, and carter pin 53*a* being inserted therethrough. As seen in FIG. 4, swivel arm 14 is secured into the idle position by means of pin 60 passing through aperture 62 provided through swivel arm 14 near the base 55 thereof, in spaced, linear relationship to aperture 54 and through aperture 10 provided through stationary arm 5 near the top 13 thereof. As seen in FIG. 3, swivel arm 14 comprises spaced-apart trusses 64, 65, reinforced by support plates 66, 67, wherein support plate 66 is preferably fixably attached to the inner wall 69 of trusses 64, 65, substantially perpendicularly thereto, and wherein support plates 67 are similarly fixably attached between trusses 64, 65, but parallel to an upper, removable arm 72 removably mounted between trusses 64, 65, of swivel arm 14, between support plates 67, by means of pin 68 passing through aperture 73 provided through upper arm 72 near the base 74 thereof, and through aperture 75 provided through swivel arm 14 at a point between support plates 67 and carter pin 68*a* being inserted therethrough. Upper arm 72 extends upwardly from swivel arm 14, substantially vertically therefrom, approximately 2 feet, in the preferred embodiment. Upper arm 72 comprises spaced-apart trusses 80, 81 reinforced by support plates 82, 83, support plate 82 being fixably attached, in the preferred embodiment, between trusses 80, 81, substantially perpendicularly thereto, support plates 83 being similarly fixably attached between trusses 80, 81, but at an approximately 45 degree angle thereto. A sleeve 85, or supporting plate 85, is mounted to upper arm 72 near the top 86 thereof, sleeve 85 being secured thereto by means of T-pin 87 passing through aperture 88 provided through sleeve 85 near the top thereof, and through aperture 89 provided through upper arm 72 near the top 86 thereof, T-pin 87 being removable, and permanent bolt 90 passing through aperture 91 provided near the bottom of sleeve 85 and through aperture 92 provided through upper arm 72. A diagonal wireline slot 93 is cut through truss 80 of upper arm 72 at a point between support plates 83. An upper sheave 94, or upper pulley wheel 94, is rotatably mounted, for example, by means of bearing pin 95, to the upper end portion 96 of upper arm 72 between trusses 80, 81, pulley 94 having an annular groove 97 for receiving wireline 32 which is driven by wireline unit 33 over pulley wheel 34 and downwardly into the oil derrick 103 for wireline operations as described in the Background of the Invention.

The apparatus 1 of the present invention can be operated in the following simple manner:

1. A workman (not shown) slides collar 3 onto the packing nut portion 4 of pack-off assembly 2 just above the bottom portion 98 of pack-off assembly 2;

2. Swivel arm 14 is put into its first, or operating position, as seen in FIG. 2, by means of the workman (not shown) inserting pin 53 through aperture 54 provided through swivel arm 14 and through aperture 12 provided through stationary arm 5;

3. The workman (not shown) inserts upper arm 72 between trusses 64, 65 of swivel arm 14, between support plates 67, and inserts pin 68 through aperture 73 of upper arm 72 and aperture 75 of swivel arm 14, thereby removably securing upper arm 72 to swivel arm 14;

4. The workman (not shown) removes pin 87 from aperture 88 of sleeve 85 and aperture 89 of upper arm 72, and pushes sleeve 85 downwardly in either direction, thereby exposing wireline slot 93 of upper arm 72;

5. The workman (not shown) then inserts wireline 32 through wireline slot 93 of upper arm 72 and between supporting plates 83 of upper arm 72 between trusses 80, 81 of upper arm 72;

6. The workman (not shown) then pushes sleeve 85 upwardly until aperture 88 of sleeve 85 and aperture 89 of upper arm 72 are perfectly aligned, then inserts pin 87 through aperture 88 of sleeve 85 and aperture 89 of upper arm 72, thereby securing sleeve 85 to upper arm 72, thereby preventing wireline 32 from slipping out of the area between trusses 80, 81 of upper arm 72;

7. The workman (not shown) then places wireline 32 into the annular groove 19 of pulley wheel 17 and into the annular groove 97 of upper pulley wheel 94;

8. Wireline operations as described in the Background of the Invention are resumed;

9. Upper pulley wheel 97 and bumper guard 44 prevent travelling block 40 and cable 42 travelling downwardly within oil derrick 103 from contacting wireline 32, during wireline operations, thereby ensuring that wireline 32 does not become frayed or damaged, upper pulley wheel 97 and lower pulley wheel 17 ensuring that wireline 32 travels along a path substantially coincidental with the longitudinal axis of pack-off assembly 2, thereby preventing damage to pack-off assembly 2 or pack-off seals 38 mounted therein, or to travelling block 40, or to cable 42 traveling downwardly within oil derrick 103 after travelling around crown block 99 at the top 104 of oil derrick 103, or to wireline 32.

The previous description is illustrative of only one embodiment of the present invention. Those skilled in the art will readily see other variations of utilizing the present invention. Changes and modifications may be made without departing from the scope of the invention which is defined by the claims.

What is claimed as invention is:

1. In an oil derrick having, inter alia, a pack-off assembly, with pack-off seals mounted with a pack-off assembly, a crown block mounted at the top of the oil derrick, a cable traveling around said crown block, and a traveling block mounted to the cable, a wireline guide apparatus, comprising:

a. an elongated stationary arm means, comprised of two parallel truss means, fixedly attached at 45° angle to a collar means of said pack-off assembly and extending upwardly and outwardly therefrom;

b. an elongated swivel arm means swivelly attached at its lower end to an uppermost portion of said stationary arm means and extending upwardly and inwardly therefrom at about a 45° angle, said swivel arm means having two parallel trust means;

c. a first pulley wheel means, rotatably mounted between said truss means and supported by an upper portion of said swivel arm means, said pulley wheel receiving the wire line and guiding it vertically downwardly into said pack-off assembly coaxially with the vertical opening in the pack-off assembly;

d. a bumper means integrally connected to said upper portion of said swivel arm means for preventing any contact between said traveling block and said wire line;

e. a plurality of support plates securedly mounted between the truss means composing said arm means, two off the lower most support plates of said swivel arm means being mounted at 45° angle in relation to said truss means;

f. a third movable arm means comprised of two parallel truss means mounted between said angularly positioned support plates and extending vertically upwardly from said swivel arm means, said third arm means having a second pulley wheel rotatably mounted between said truss means for receiving and guiding said wireline, said third arm further having a plurality of reinforcing plates attached between said truss means, a pair of uppermost reinforcing plates being mounted at 45° angle in relation to said truss means, said third arm means being further provided with a sleeve means to cover a diagonal opening made in one of the truss means of said third arm means.

2. The apparatus of claim 1, wherein said swivel arm means is swivelly connected to said stationary arm means for movement between an operating position, wherein an annular groove of said first pulley wheel means is substantially aligned with the longitudinal axis of said pack-off assembly, and an idle position wherein said swivel arm means is swung 180° outwardly from said pack-off assembly not to impede oil rig operation.

3. The apparatus of claim 1, wherein said bumper means comprises a generally polygonal, hollow member fixably attached to the outer end of said swivel arm means for preventing contact between said travelling block and said wireline.

4. The apparatus of claim 1, wherein a diagonal, wireline slot is provided through the truss means of said third arm means at a point between said pair of reinforcing plates fixably attched between said trusses at 45° angle thereto.

5. The apparatus of claim 1, wherein said sleeve mounted to said third arm means in covering relationship to said wireline slot is hingedly attached to said third arm means for movement between a first position wherein said sleeve is not in covering relationship to said wireline slot and a second position wherein said sleeve is in covering relationship to said wireline slot.

* * * * *